United States Patent [19]

Tai et al.

[11] Patent Number: 4,980,274

[45] Date of Patent: Dec. 25, 1990

[54] SILVER HALIDE PHOTOGRAPHIC LIGHT-SENSITIVE MATERIAL

[75] Inventors: Akiyoshi Tai; Shun Takada; Hisayoshi Tsurui, all of Odawara, Japan

[73] Assignee: Konica Corporation, Tokyo, Japan

[21] Appl. No.: 398,242

[22] Filed: Aug. 24, 1989

[30] Foreign Application Priority Data

Aug. 30, 1988 [JP] Japan ..... 63-217139

[51] Int. Cl.[5] ..... G03C 1/76

[52] U.S. Cl. ..... 433/533; 430/570; 430/517; 430/523; 430/950

[58] Field of Search ..... 430/510, 523, 950, 533, 430/517

[56] References Cited

U.S. PATENT DOCUMENTS

| | | | |
|---|---|---|---|
| 4,506,002 | 3/1985 | Takaki et al. | 430/510 |
| 4,585,730 | 4/1986 | Cho | 430/523 |
| 4,828,971 | 5/1989 | Przezdziecki | 430/523 |

*Primary Examiner*—Jack P. Brammer

*Attorney, Agent, or Firm*—Jordan B. Bierman

[57] ABSTRACT

A silver halide photographic light-sensitive material having a support, provided thereon a silver halide emulsion layer, and a backing layer provided on a reverse side of said silver halide emulsion layer is disclosed. Said support is of white color polyester or comprises a layer containing a white pigment and provided on a side of the silver halide emulsion layer; and the transmittances of the support, the support plus the backing layer, and the silver halide photographic light-sensitive material in 450 nm, 550 nm and 700 nm satisfy the following equations;

$$\alpha_{700}=T_{B700}T_{A700}=0.30 \text{ to } 0.70$$
$$\beta_{700}=T_{A700}/T_{0700}=0.05 \text{ to } 0.30$$
$$\alpha_{550}=T_{B550}/T_{A550}=0.60 \text{ to } 0.90$$
$$\beta_{550}=T_{A550}/T_{0550}=0.10 \text{ to } 0.50$$
$$\alpha_{450}=T_{B450}/T_{A450}=0.60 \text{ to } 0.90$$
$$\beta_{450}=T_{A450}/T_{0550}=0.15 \text{ to } 0.50$$

wherein $T_{0700}$, $T_{0550}$ and $T_{0450}$ represent the transmittances of the support in 700 nm, 550 nm and 450 nm, respectively; $T_{A700}$, $T_{A550}$ and $T_{A450}$ represent the transmittances of the support plus the backing layer in 700 nm, 550 nm and 450 nm, respectively, and $T_{B700}$, $T_{B550}$ and $T_{B450}$ represent the transmittances of the silver halide photographic light-sensitive material in 700 nm, 550 nm and 450 nm, respectively.

16 Claims, No Drawings

SILVER HALIDE PHOTOGRAPHIC LIGHT-SENSITIVE MATERIAL

FIELD OF THE INVENTION

The present invention relates to a silver halide photographic light-sensitive material, especially relates to a silver halide photographic light-sensitive material for photo display use comprising an excellent balance between sensitivity and sharpness.

BACKGROUND OF THE INVENTION

In recent years, there have been increasing displays by color photographic in department stores, platforms of subways, restaurants, lobbies of hotels, and so on.

A display method by such photo display includes a method in which an image formed on a support is displayed by light irradiated from an image side, and a method in which an image is displayed by light transmitted from a backside of the image. It is self explanatory that in such specific conditions as in a dark room or outdoor at night, the latter method can give a clearer image.

However, the transmission method displaying an image by transmitted light requires a light-sensitive material capable of providing an image with higher density than that of conventional one. Therefore, the amounts of silver and a coupler contained in the light-sensitive material used in this method increases inevitably to a large extent.

Further, a light-sensitive material for display, which is usually displayed in a large size, requires higher sharpness.

However, the increased amounts of silver and a coupler for obtaining a higher image density result in a thicker layer, which in turn causes such problems as deterioration of sharpness, insufficient drying, and sweating.

If there would be available a light-sensitive material which could provide a good displayed image either in a reflection method or a transmission method, it would be advantageously applied in such place as variable in brightness surrounding the display to a large extent; for example, on a street it is displayed in natural daylight at daytime, and by artificial illumination from a backside at night.

A method for solving this problem is disclosed in Japanese Patent Open to Public Inspection Publication (hereinafter, referred to as Japanese Patent O.P.I. Publication) No. 141049/1988, in which there is used a transparent support having a white pigment coated thereon or kneaded therein.

However, a light-sensitive material using the above support is liable to comprise inferior sharpness to conventional color paper.

A method to improve sharpness is disclosed in Japanese Patent O.P.I. Publication Nos. 14152/1987, 165656/1987 and 83521/1987, in which an anti-irradiation dye is used. However, there is liable to be desensitized remarkably a light-sensitive material having a support coated thereon or kneaded therein with a white pigment, and provided thereon a dye enough to give satisfactory sharpness for a photo display.

It is also a known method for improving sharpness to provide an antihalation layer on a side of a silver halide emulsion layer or on a backside thereof.

However, the antihalation layer provided on a side of a silver halide emulsion layer results in lowered sensitivity due to reflection in exposure. Therefore, it is preferable to provide the antihalation layer on the backside. Even thereby, however, sharpness is still not improved to a satisfactory level.

SUMMARY OF THE INVENTION

An object of the present invention is to provide a silver halide light-sensitive material capable of forming an image comprising an optimum density and excellent sharpness, which enable the light-sensitive material to be applicable in either reflection or transmission system.

The above object of the invention can be accomplished by a silver halide photographic light-sensitive material having a support, provided thereon at least one silver halide emulsion layer, and a backing layer provided on a reverse side of the silver halide emulsion layer, wherein said support is of white color polyester or comprises a layer containing a white pigment and provided on a side of the silver halide emulsion layer; the transmittances of the support, the support plus the backing layer, and the silver halide photographic light-sensitive material in 450 nm, 50 nm and 700 nm satisfy the following equations;

| | |
|---|---|
| $\alpha_{700} = T_{B700}/T_{A700}$ | $\alpha_{700} = 0.30 \sim 0.70$ |
| $\beta_{700} = T_{A700}/T_{O700}$ | $\beta_{700} = 0.05 \sim 0.30$ |
| $\alpha_{550} = T_{B550}/T_{A550}$ | $\alpha_{550} = 0.60 \sim 0.90$ |
| $\beta_{550} = T_{A550}/T_{O550}$ | $\beta_{550} = 0.10 \sim 0.50$ |
| $\alpha_{450} = T_{B450}/T_{A450}$ | $\alpha_{450} = 0.60 \sim 0.90$ |
| $\beta_{450} = T_{A450}/T_{O450}$ | $\beta_{450} = 0.15 \sim 0.50$ |

wherein $T_{0700}$, $T_{0550}$ and $T_{0450}$ represent the transmittances of the support in 700 nm, 550 nm and 450 nm, respectively; $T_{A700}$, $T_{A550}$ and $T_{A450}$ represent the transmittances of the support plus the backing layer in 700 nm, 550 nm and 450 nm, respectively; $T_{B700}$, $T_{B550}$ and $T_{B450}$ represent the transmittances of the silver halide light-sensitive material in 700nm, 550 nm and 450 nm, respectively.

DETAILED DESCRIPTION OF THE INVENTION

In the present invention, the transmittances of the support, $T_{0700}$, $T_{0550}$ and $T_{0450}$are usually 10–25%, 10–30% and 5–30%, and preferably 15–25%, 18–25% and 16–25%, respectively.

In the invention, the transmittance are the average transmittances in five sites of a sample in 700, 550 and 450 nm, which are measured with a dual-wavelength automatic spectrophotometer Type 556 manufactured by Hitachi Co., Ltd.

In $\alpha_{700}$ to $\beta_{450}$, preferably $\alpha_{700}$ is 0.45 to 0.60, $\beta_{700}$ is 0.05 to 0.20, $\alpha_{550}$ is 0.70 to 0.85, $\beta_{550}$ is 0.15 to 0.30, $\alpha_{450}$ is 0.70 to 0.85, and $\beta_{450}$ is 0.20 to 0.35; more preferably $\alpha_{700}$ is 0.50 to 0.55, $\beta_{700}$ is 0.08 to 0.15, $\alpha_{550}$ is 0.73 to 0.82, $\beta_{550}$ is 0.18 to 0.25, $\alpha_{450}$ is 0.72 to 0.82, and $\beta_{450}$ is 0.23 to 0.33.

The support of the invention has no limitation so far as it contains white pigment or is provided with a hydrophilic colloid layer containing white pigment on a transparent support, however from the viewpoint of drying property after processing, the support containing white pigment therein is preferable.

The white pigment includes inorganic and organic pigments, and preferably the inorganic pigments including sulfate and carbonate of an alkali earth metal such as barium sulfate and calcium carbonate; fine powder silicone acid, synthetic silicate; calcium silicate; almina; almina hydrade; titanium oxide; zinc oxide; talc; and clay. Among them, more preferable are barium sulfate, calcium carbonate, and titanium oxide, and further more preferable are barium sulfate and titanium oxide.

An addition amount of the white pigment contained in the support is preferably 5 to 50% by weight of the support.

Any one may be used as the support of the invention as far as it has an oxygen transmittance of not more than 2.0 m /$m^2$.hr.atm, preferably of not more than 1.0 m /$m^2$.hr.atm. The materials which satisfy the above requirement are plastic film and so on.

The oxygen transmittance can be measured by a conventional method regulated in ASTM D-1434. This measuring method is applied also to the invention.

The plastics to compose the support of the invention includes polyester such as polyethylene terephthalate; homopolymer and copolymer of vinyl alcohol, vinyl chloride, vinyl fluoride, ad vinyl acetate; cellulose acetate; homopolymer and copolymer of acrylonitrile, methacrylonitrile, alkyl acrylate, alkyl methacrylate, and alkyl vinylether; and polyamide.

Among these polymers, especially preferable is polyester film because it has no humidity dependency on an oxygen transmittance, and therefore has the same oxygen transmittance in a high humidity condition as in a dry condition.

The thickness of the support is normally 150 to 250 μm, preferably 160 to 200 μm.

In the light-sensitive material of the invention, an antihalation layer containing a light-absorbing substance (an antihalation agent) is provided on an opposite side of a light-sensitive emulsion layer.

This agent has an effect to prevent halation caused by the support by absorbing light transmitted through the emulsion layer.

The above antihalation agent includes various inorganic substances and organic substances (dyes) each having the above effect.

The inorganic substances include a colloidal metal. The organic substances include such dye as fixed to a polymer for stabilization (a kind of a mordant dye) so that it does not elute into a color developer. When the antihalation dye fixed to a polymer mordant is used, it is difficult not only to coat it uniformly but also to eliminate it after color developing, so that bleaching may be necessary.

The inorganic substances used in the invention are preferably colloidal silver and colloidal manganese, and more preferably colloidal silver. The above substances are preferably applied to a color photographic light-sensitive material because of decoloration property thereof. Colloidal silver is prepared in the following manner; silver nitrate dissolved in a gelatin solution is reduced in an alkaline condition in the presence of a reducing agent such as hydroquinone, phenidon, ascorbic acid, pyrogallol or dextrin; then, it is neutralized, cooled, and precipitated together with gelatin to remove the reducing agent and unnecessary salts by a noodle washing method. Colloidal silver dispersion comprising uniform grains can be prepared by forming colloidal silver grains in the presence of azaindene and mercaptan compounds in an alkaline reduction.

The antihalation dye used in the invention is requested to satisfy various conditions; it is to have good spectral absorption property by application; it is to be bleached perfectly without eluting easily from an emulsion layer and causing stain by remained dye after developing; it is to exert no bad actions such as fogging and desensitization to a light-sensitive emulsion; it is to have an excellent aging stability in a solution and a light-sensitive material without causing discoloration and fading.

So far, a lot of efforts have been concentrated on discovering the antihalation dyes which meet the above conditions, and many dyes have been proposed; an oxonol dye is described in U.S. Pat. No. 506,385, 3,247,127, Japan Patent Publication No. 22069/1964 and 13168/1968; a styryl dye is described in U.S. Pat. No. 1.845,404; a merocyanine dye is described in U.S. Pat. No. 2,493,747, 3,148,187 and 3,282,699; a cyanine dye is described in U.S. Pat. No. 2,843,486; an anthraquinone dye is described in U.S. Pat. No. 2,865 752. In the invention, preferable a high decomposable dye described in Japanese Patent O.P.I. Publication No. 327694/1987.

Among the above inorganic substances and dyes, most preferable is colloidal silver.

An addition amount of colloidal silver is usually 0.5 to 5.0 mg/$dm^2$, and preferably 1.0 to 2.0 mg/$dm^2$.

The light-sensitive material of the invention can be used either for a monochrome photographic light-sensitive material or for a color photographic light-sensitive material. Where it is used for the color photographic light-sensitive material, a yellow coupler, a magenta coupler and a cyan coupler normally used in the art can be used in a conventional manner. There may be used a colored coupler which has an effect of color adjustment, or a DIR coupler which releases a development inhibitor in developing. If necessary, more than two kinds of the above couplers may be used for one layer in combination, and one coupler may be used for more than two different layers.

The yellow coupler used in the invention includes a conventional open-chained ketomethylene type coupler, a benzoyl type coupler, an acetanilide type coupler, and a pivaloyl acetanilide type coupler. The examples thereof are described in U.S. Pat. Nos. 2,875,057, 3,265,506, 3,277,155, 3,408,194, 3,415,652, 3,447,928, and 3,664,841; Japanese Patent Publication No. 13574/1974; Japanese Patent O.P.I. Publication No. 29432/1973, 66834/1973, 10736/1974, 122335/1974, 28834/1975, and 132926/1975.

Among these yellow couplers, preferable is the pivaloyl acetanilide type coupler, and especially preferable is a diequivalent pivaloyl acetanilide coupler from the view-point of coloring.

An addition amount thereof is preferably $1\times10^{-3}$ to 2 mol per mol of silver in a silver halide emulsion layer, and more preferably $1\times10^{-2}$ to $8\times10^{-1}$ mol per mol of silver.

The magenta coupler used in the invention includes a conventional 5-pyrazolone type coupler, a pyrazolobenzimidazole type coupler, a pyrazolotriazole type coupler, and an open-chained acylacetonitrile type coupler. The examples of these magenta couplers are described in Japanese Patent Publication No. 6031/1965, 6035/1965, 40757/1970, 27411/1972, and 37854/1974; Japanese Patent O.P.I. Publication No. 13041/1975, 26541/1976, 37646/1976, 105820/1976, 42121/1977, 123129/1978, 125835/1978, 129035/1978, 48540/1979, 29236/1981, 75648/1981, 17950/1982, 35858/1982, 146251/1982, and 99437/1984; British Patent No. 1,252,418; U.S. Pat. No. 2,600,788, 3,005,712, 3,062,653, 3,127,269, 3,214,437, 3,253,924, 3,311,476, 3,419,391, 3,519,429, 3,588,319, 3,582,322, 3,615,506, 3,658,544, 3,705,896, 3,725,067, 3,758,309, 3,823,156, 3,834,908, 3,891,445, 3,907,571, 3,926,631, 3,928,044, 3,935,015, 3,960,571, 4,076,533, 4,133,686, 4,237,217, 4,241,168, 4,264,723, 4,301,235, and 4,310,623.

Among them, preferable are an anilinopyrazolone type coupler and a pyrazolotriazole type coupler.

An addition amount thereof is normally $1\times10^{-3}$ to 2 mol per mol of silver in a silver halide emulsion layer, and preferably $1\times10^{-2}$ to $8\times10^{-1}$ mol per mol of silver. The cyan coupler used in the invention includes the derivatives of phenol and naphtol.

The examples of these cyan couplers are described in U.S. Pat. No. 2,423,730, 2,474,293, 2,801,171, 2,895,826, 3,476,563, 3,737,316, 3,758,308, and 3,839,044; Japan Patent O.P.I. Publication No. 37425/1972, 10135/1975, 25228/1975, 112038/1975, 117422/1975, 130441/1975, 109630/1978, 16353/1980, 29235/1981, 55945/1981, 65134/1981, 80045/1981, 99341/1981, 116030/1981, 104333/1981, 31953/1984, 124341/1984, and 209735/1985.

Among the above cyan couplers, preferable is a phenol type cyan coupler. An addition amount thereof is normally $1\times10^{-3}$ to 2 mol per mol of silver in a silver halide emulsion layer, and preferably $1\times10^{-2}$ to $8\times10^{-1}$ mol per mol of silver.

An image stabilizer for preventing deterioration of a dye image may be incorporated into a light-sensitive material of the invention.

The image stabilizer includes a hydroquinone derivative, a gallic acid derivative, a phenol derivative and a bis compound thereof, hydroxycoumarone and a spiro compound thereof, a hydroxycumaran and a spiro compound thereof, a piperidine derivative, an aromatic amine compound, a benzodioxane derivative, a benzoxole derivative, a silicone compound, and a thioether compound. The examples thereof are described in British Patent No. 1,410,846; Japanese Patent O.P.I. Publication No. 134326/1974, 35633/1977, 147434/1977, 150630/1977, 145530/1979, 6321/1980, 21004/1980, 124141/1980, 3432/1984, 5246/1984, and 10539/1984; Japanese Patent Publication No. 31625/1973, 20973/1974, 20974/1974, 23813/1975, and 27534/1977; U.S. Pat. No. 2,360,290, 2,418,613, 2,675,314, 2,701,197, 2,704,713, 2,710,801, 2,728,659, 2,732,300, 2,735,765, 2,816,028, 3,069,262, 3,336,135, 3,432,300, 3,457,079, 3,573,050, 3,574,627, 3,698,909, 3,700,455, 3,764,337, 3,935,016, 3,982,944, 4,013,701, 4,113,495, 4,120,723, 4,155,765, 4,159,910, 4,254,216, 4,268,593, 4,279,990, 4,332,886, 4,360,589, 4,430,425, and 4,452,884.

The above image stabilizers are especially effective for a magenta dye image. A hindered phenol derivative, a hindered amine derivative and a benzotriazole derivative are effective for the cyan and yellow dye images, which are described in Japan Patent O.P.I. Publication No. 222853/1985 and 222854/1985.

Such hydrophobic compounds as the above couplers can be dispersed by conventional methods such as a solid dispersion method, a latex dispersion method, and an oil-in-water emulsification method The oil-in-water emulsification can be carried out by the following conventional method; couplers are dissolved independently or in a mixture in a high boiling organic solvent including phthalate such as dibutyl phthalate and dioctylphthalate, phosphate such as tricresyl phosphate, triphenyl phosphate and trioctyl phosphate, and N,N-dialkyl amide such as N,N-diethyllauryl amide, and in a low boiling organic solvent such as ethyl acetate, butyl acetate and butyl propionate, or if necessary in a mixture thereof; the above solution is mixed with a gelatin solution containing an anionic, nonionic or cationic surfactant, and then it is dispersed to an emulsion with a high speed rotation mixer, a colloid mill or a supersonic disperser.

A gelatin used in the invention includes a gelatin derivative such as acylated gelatin, guanidinated gelatin, carbaminated gelatin, cyanohydroxyethylated gelatin, and esterified gelatin.

In the present invention, there is no limit to a layer constitution of a light-sensitive material. Preferably, however, a cyan dye image-forming layer of the silver halide emulsion layers is provided furthest from a support; more preferably, there are provided on the support, a magenta dye image-forming layer, an intermediate layer, a yellow dye image-forming layer, a UV-absorbing layer, a cyan dye image-forming layer, a UV-absorbing layer, and a protective layer in this order from the support; or a yellow dye image-forming layer, an intermediate layer, a magenta dye image-forming layer, a UV-absorbing layer, a cyan dye image-forming layer, a UV-absorbing layer, and a protective layer in this order from the support Especially preferable is the latter.

In the present invention, conventional silver halide such as silver bromide, silver bromoiodide, silver chloroiodide, silver bromochloride and silver chloride is contained in an emulsion.

Silver halide grains may be formed by any of an acid method, a neutral method and an ammonium method. The grains may be grown either as they are or via seed grains. The methods for preparing the seed grains and growing them may be the same or different.

A silver halide emulsion may be prepared either by adding simultaneously a halide ion and a silver ion or by adding one of the above ions to a solution containing the other. Further, in view of a critical growth rate of a silver halide crystal, it may be grown by adding the halide and silver ions under control of pH and pAg in a reactor. A composition of silver halide grains may be varied by a conversion method after completion of growth.

There may be controlled a grain size, a grain form, a distribution of a grain size, a growing speed of a grain by adding a silver halide solvent in preparing a silver halide emulsion, if necessary.

In forming and/or growing grains, a metal ion may be doped therein and/or thereon by adding a cadmium salt, a zinc salt, a lead salt, a thallium salt, an iridium salt or a complex thereof, a rhodium salt or a complex thereof, and an iron salt or a complex thereof; further, reduction sensitizing nucleus may be provided therein and/or thereon by letting it stand in a reduction condition.

Soluble waste salts may be removed from a silver halide emulsion after finishing growth of grains, or may be contained therein as they are. They can be removed by a method described in Research Disclosure 17643.

Silver halide grains may be either of uniform or different compositions in a core and an outer shell.

A latent image may be formed mainly on a surface of a silver halide grain or therein.

A silver halide grain may be of an isotropic crystal or of an anisotropic crystal such as cube and plate, in which a ratio of (100) face to (111) face may be arbitrary. It may be of a complex crystal or a mixture of various crystals.

Further, there may be mixed more than two kinds of silver halide emulsions which are prepared independently. A silver halide emulsion is chemically sensitized by a conventional method such as a sulfur sensitizing method, a selenium sensitizing method, a reduction sensitizing method, and a noble metal method, singly or combinedly.

A silver halide emulsion is spectrally sensitized to a desired wavelength range by a sensitizing dye. The sensitizing dye may be used singly or in combination of more than two. The other dyes or a supersensitizing dye may be incorporated into a silver halide emulsion.

An antifoggant and a stabilizer may be added to the emulsion.

In a light-sensitive material of the invention, a coated amount of silver is preferably 10 to 30 mg/dm$^2$.

Gelatin is preferably used as a binder or a protective colloid for a silver halide emulsion. Besides above, there may be used a gelatin derivative, a graft polymer of gelatin with other polymers, protein, a sugar derivative, a cellulose derivative, and a hydrophilic colloid such as a homo- and copolymerized synthetic hydrophilic high-molecular compound.

A hydrophilic colloid layer is hardened with a hardener in order to crosslink binder molecules for reinforcing layer strength. The hardener may be incorporated either into a coating solution or a developing solution.

A light-sensitive material of the invention may incorporate a plasticizer for increasing flexibility, a synthetic polymer latex for improving size stability, an antistain agent for preventing color stain and deterioration of sharpness, and a UV absorber for preventing deterioration of image caused by ultra-violet light.

Subsidiary layers such as a filter layer, an antihalation layer and an anti-irradiation layer may be provided on a light-sensitive material of the invention. There may be incorporated into these layers and/or the light-sensitive layers a dye which elutes from the light-sensitive materials or is bleached in developing.

Further, the light-sensitive material of the invention may incorporate a surfactant, a matting agent, a lubricant and an antistatic agent The antistatic agent may be provided on a side or a backside of an emulsion layer.

A subbing layer may be provided.

In the invention, a thickener may be used for improving efficiency of coating. There are applied preferably an extrusion coating method and a curtain coating method by which more than two layers are coated simultaneously.

The light-sensitive material of the invention may be exposed with a conventional light source such as natural light, a tungsten lump, a fluorescent lump, and a mercury lamp.

A primary aromatic amine color developing agent used in the invention includes a conventional color developing agent such as aminophenol and p-phenylenediamine derivatives. Usually, these compounds are used in a concentration of about 0.1 to 30 g per liter, preferably about 1 g to 15 g per liter of a color developer.

The aminophenol type developing agent includes o-aminophenol, 5-amino-2-oxytoluene, and 2-oxy-3-amino-1,4-dimethylbenzene.

The primary aromatic amine type color developing agent includes N-methyl-p-phenylenediamine hydrochloride salt, N,N-dimethyl-p-phenylenediamine hydrochloride salt, 2-amino-5-(N-ethyl-N-dodecylamino) toluene, N-ethyl-N-$\beta$-methanesulfonamide ethyl-3-methyl-4-aminoaniline sulfate, N-ethyl-N-$\beta$-hydroxyethylaminoaniline, 4-amino-3-methyl-N, N-diethylaniline, and 4-amino-N-(2-metoxyethyl)-N-ethyl-3-methylaniline-p-toluene sulfonate.

In the invention, the conventional compounds may be added to the color developer as well as the color developing agents.

pH of the color developer is normally not lower than 7, and preferably 10 to 13. A temperature thereof is normally not lower than 15° C., and preferably 20° C. to 50° C. In rapid processing, it is preferably not lower than 30° C. Developing time is preferably not longer than two and a half minutes, and more preferably 30 seconds to 2 minutes In the invention, bleaching and fixing may be carried out independently or simultaneously after developing. A metal complex of organic acid is used as a bleaching agent.

The examples thereof are shown as follows;

(1) Ethylenediamine tetraacetic acid
(2) Nitrilotriacetic acid
(3) Iminodiacetic acid
(4) Disodium ethylenediamine tetraacetate
(5) Tetra(trimethyl ammonium) ethylenediamine tetraacetate
(6) Tetrasodium ethylenediamine tetracetate
(7) Sodium nitrilotriacetate A bleaching solution may contain conventional additives as well as the above metallic complex of organic acid.

EXAMPLES

Hereunder, the examples are shown to explain the invention in more detail. However, it is to be understood that the scope of the invention is not limited thereto

Example 1

A silver halide emulsion is coated on a semitransparent support prepared by incorporating 10g/m$^2$ of barium sulfate into a transparent polyethylene telephtalate film with thickness of 180 $\mu$m, as shown in Table 1.

In the table, an addition amount is indicated by g/m$^2$, and those of silver halide emulsion and colloidal silver are indicated by an amount converted to silver The amounts of a sign * are controlled so that $\alpha_{700}$, $\beta_{700}$, $\alpha_{550}$, $\beta_{550}$, $\alpha_{450}$, and $\beta_{450}$ become the values shown in Table 2.

TABLE 1

| Layer | Components | Addition amount |
|---|---|---|
| Seventh layer (Protective layer) | Gelatin | 0.9 |
| Sixth layer (Third intermidiate layer) | Gelatin | 0.6 |
| | UV absorber (UV-1) | 0.2 |
| | UV absorber (UV-2) | 0.1 |
| | Antistain agent (AS-1) | 0.02 |
| | High boiling solvent (DNP) | 0.2 |
| Fifth layer (Red-sensitive layer) | Gelatin | 3.0 |
| | Silver bromochloride emulsion (AgBr 70 mol %) | 0.4 |
| | Cyan coupler (C-1) | 0.25 |
| | Cyan coupler (C-2) | 0.65 |
| | Image stabilizer (ST-1) | 0.4 |
| | Antistain agent (AS-1) | 0.02 |
| | High boiling solvent (DOP) | 0.4 |
| | Anti-irradiation dye (AI-2) | * |
| Fourth layer (Second intermidiate | Gelatin | 1.0 |
| | UV absorber (UV-1) | 0.5 |
| | UV absorber (UV-2) | 0.2 |

TABLE 1-continued

| Layer | Components | Addition amount |
|---|---|---|
| layer) | Antistain agent (AS-1) | 0.03 |
| | High boiling solvent (DNP) | 0.3 |
| | Anti-irradiation dye (AI-1) | * |
| Third layer (Green-sensitive layer | Gelatin | 2.0 |
| | Silver bromochloride emulsion (AgBr 70 mol %) | 0.5 |
| | Magenta coupler (M-1) | 0.7 |
| | Image stabilizer (ST-3) | 0.4 |
| | Image stabilizer (ST-4) | 0.2 |
| | Antistain agent (AS-1) | 0.02 |
| | High boiling solvent (DOP) | 0.5 |
| Second layer (First intermidiate layer) | Gelatin | 1.0 |
| | Antistain agent (AS-1) | 0.07 |
| | High boiling solvent (DIDP) | 0.4 |
| First layer (Blue-sensitive layer | Gelatin | 2.6 |
| | Silver bromochloride emulsion (AgBr 90 mol %) | 0.6 |
| | Yellow coupler (Y-1) | 1.9 |
| | Image stabilizer (ST-1) | 0.8 |

TABLE 1-continued

| Layer | Components | Addition amount |
|---|---|---|
| | Image stabilizer (ST-2) | 0.4 |
| | Antistain agent (AS-1) | 0.04 |
| | High boiling solvent (DNP) | 0.6 |
| Support | Polyethylene terephthalate containing $BaSO_4$ | |
| First backing layer | Gelatin | 2.0 |
| | UV absorber agent (UV-1) | 0.5 |
| | UV absorber agent (UV-2) | 0.2 |
| | Colloidal silver | * |
| Second backing layer (Protective layer) | Gelatin | 1.0 |
| | Colloidal silver | * |

DOP: dioctylphthalate
DNP: dinonylphthalate
DIDP: di-iso-decylphthalate

The following dyes are used as a spectral sensitizer for each emulsion layer.

(Blue-sensitive layer)

D-1

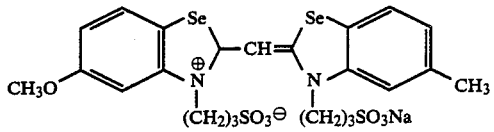

(Green-sensitive layer)

D-2

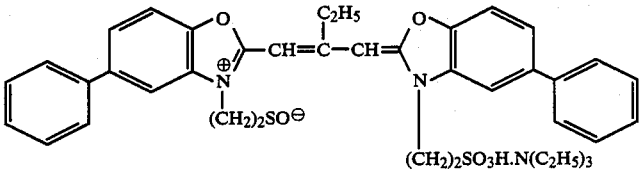

(Red-sensitive layer)

D-3

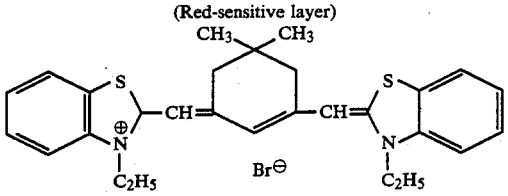

Y-1

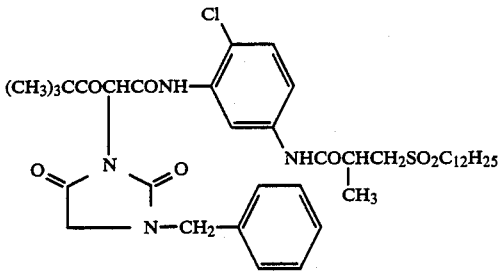

M-1

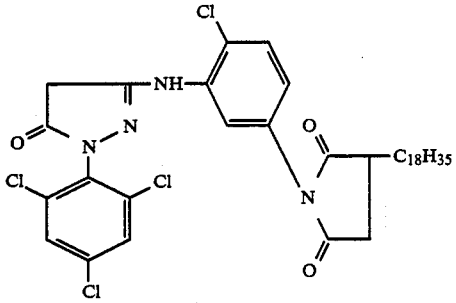

-continued
C-1
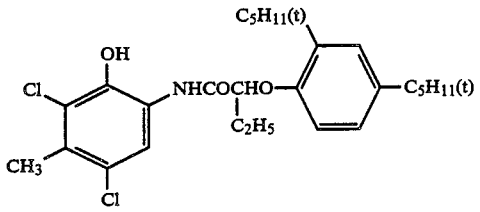
C-2
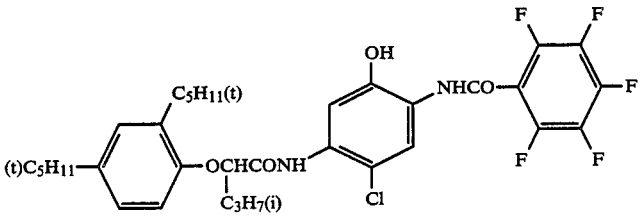
ST-1
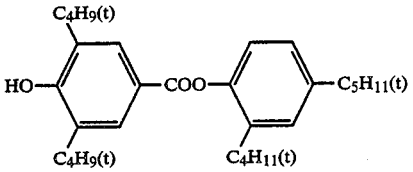
ST-2
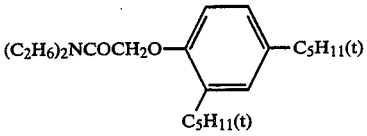
ST-3
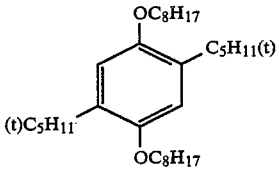
ST-4
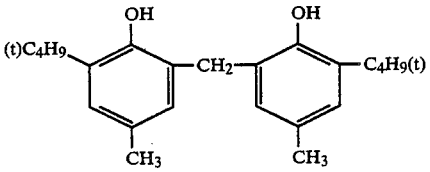
UV-1
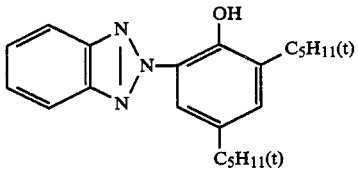
UV-2
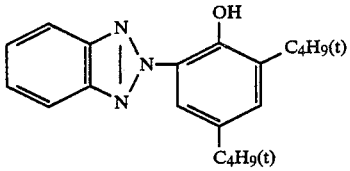

-continued

AS-1

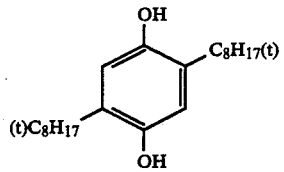

A sample was exposed by a conventional method, and processed in the following processes;

| Process A | Temperature | Time |
|---|---|---|
| Color developing | 33° C. | 7 minutes |
| Bleaching and fixing | 33° C. | 3 minutes |
| Washing | 33° C. | 3 minutes |

| Color developer | |
|---|---|
| N-ethyl-N-β-methanesulfonamide ethyl-3-methyl-4-aminoaniline sulfate | 4.9 g |
| Hydroxylamine sulfate | 2.0 g |
| Potassium carbonate | 25.0 g |
| Sodium bromide | 0.6 g |
| Sodium sulfite anhydride | 2.0 g |
| Benzyl alcohol | 13 ml |
| polyethylene glycol | 3.0 ml |

(average degree of polymerization: 400)

Water was added to make total quantity 1 liter. pH was adjusted to 10.0 with sodium hydroxide.

| Bleach-fixer | |
|---|---|
| Ferric ammonium ethylenediamine tetraacetate | 60 g |
| Ammonium thiosulfate | 100 g |
| Sodium bisulfite | 10 g |
| Sodium metabisulfite | 3 g |

Water was added to 1 lit., and the pH was adjusted to 7.0 with aqueous ammonia.

Each sample was evaluated as follows;

(1) Sensitometry

The exposed and processed sample was subjected to sensimetory measurement with a sensitometer PDA-65 manufactured by Konica to obtain sensitivity and maximum density (Dmax).

(2) Sharpness

Each sample was exposed to blue light, green light and red light via a resolution test chart, and was processed in Process A. Then, each density of a yellow dye image, a magenta dye image and a cyan dye image on the processed sample was measured with a microphotometer, and sharpness was calculated by the following equation;

$$\text{Sharpness (\%)} = \frac{(D\text{max} - D\text{min}) \text{ in line density of 5 line/mm}}{(D\text{max} - D\text{min}) \text{ in large area}} \times 100$$

The larger the value, the more excellent the sharpness is.

(3) Practicability

The processed sample was visually observed via reflected and transmitted light, and classified to five grades.

5: Very excellent
4: Excellent
3: Ordinary
2: Poor
1: No practicability

The evaluation results are summarized in Table 2.

TABLE 2

| Sample No. | Total silver amount ($g/m^2$) | $T_{o700}$ (%) | $T_{o550}$ (%) | $T_{o450}$ (%) | $\alpha_{700}$ | $\beta_{700}$ | $\alpha_{550}$ | $\beta_{550}$ | $\alpha_{450}$ | $\beta_{450}$ |
|---|---|---|---|---|---|---|---|---|---|---|
| 1 (Comp.) | 18.5 | 20 | 20 | 17 | 0.484 | 0.939 | 0.571 | 0.897 | 0.542 | 0.578 |
| 2 (Comp.) | 19.2 | 15 | 21 | 19 | 0.471 | 0.986 | 0.392 | 0.896 | 0.667 | 0.894 |
| 3 (Comp.) | 17.2 | 14 | 13 | 10 | 0.054 | 0.613 | 0.750 | 0.096 | 0.789 | 0.102 |
| 4 (Comp.) | 15.0 | 19 | 22 | 22 | 0.526 | 0.520 | 0.771 | 0.085 | 0.766 | 0.265 |
| 5 (Comp.) | 9.9 | 19 | 23 | 21 | 0.533 | 0.405 | 0.566 | 0.188 | 0.771 | 0.250 |
| 6 (Inv.) | 9.9 | 19 | 22 | 22 | 0.526 | 0.111 | 0.771 | 0.111 | 0.754 | 0.256 |
| 7 (Inv.) | 15.0 | 18 | 22 | 21 | 0.526 | 0.104 | 0.771 | 0.221 | 0.767 | 0.278 |
| 8 (Inv.) | 15.5 | 20 | 22 | 22 | 0.470 | 0.290 | 0.611 | 0.224 | 0.660 | 0.278 |
| 9 (Inv.) | 19.0 | 19 | 22 | 22 | 0.527 | 0.100 | 0.780 | 0.200 | 0.766 | 0.296 |
| 10 (Inv.) | 25.3 | 19 | 23 | 22 | 0.520 | 0.125 | 0.762 | 0.215 | 0.701 | 0.287 |
| 11 (Inv.) | 33.0 | 19 | 21 | 22 | 0.514 | 0.150 | 0.792 | 0.211 | 0.811 | 0.320 |
| 12 (Inv.) | 15.5 | 8 | 22 | 21 | 0.310 | 0.247 | 0.770 | 0.230 | 0.758 | 0.277 |
| 13 (Inv.) | " | 19 | 9 | 22 | 0.527 | 0.110 | 0.799 | 0.499 | 0.771 | 0.280 |
| 14 (Inv.) | " | 19 | 21 | 12 | 0.521 | 0.120 | 0.772 | 0.225 | 0.611 | 0.478 |

| | Sharpness | | | Sensitivity | | | Dmax | | | Practi- |
|---|---|---|---|---|---|---|---|---|---|---|
| Sample No. | Y | M | C | Y | M | C | Y | M | C | cability |
| 1 (Comp.) | 0.51 | 0.69 | 0.70 | 101 | 102 | 99 | 2.40 | 2.43 | 2.41 | 3 |
| 2 (Comp.) | 0.31 | 0.50 | 0.49 | 102 | 101 | 100 | 2.10 | 2.01 | 2.09 | 2 |
| 3 (Comp.) | 0.35 | 0.45 | 0.61 | 91 | 92 | 88 | 2.11 | 2.10 | 2.07 | 2 |
| 4 (Comp.) | 0.32 | 0.56 | 0.44 | 100 | 100 | 100 | 2.01 | 2.03 | 2.05 | 2 |
| 5 (Comp.) | 0.33 | 0.48 | 0.55 | 81 | 83 | 87 | 1.51 | 1.49 | 1.48 | 2 |
| 6 (Inv.) | 0.59 | 0.52 | 0.65 | 88 | 89 | 90 | 1.77 | 1.69 | 1.77 | 3 |
| 7 (Inv.) | 0.75 | 0.77 | 0.80 | 107 | 106 | 108 | 2.51 | 2.54 | 2.57 | 5 |
| 8 (Inv.) | 0.74 | 0.82 | 0.85 | 109 | 107 | 110 | 2.59 | 2.58 | 2.65 | 5 |
| 9 (Inv.) | 0.71 | 0.73 | 0.79 | 116 | 117 | 115 | 2.66 | 2.70 | 2.68 | 5 |

TABLE 2-continued

| | | | | | | | | | | |
|---|---|---|---|---|---|---|---|---|---|---|
| 10 (Inv.) | 0.70 | 0.77 | 0.81 | 118 | 120 | 120 | 3.12 | 3.37 | 3.22 | 4 |
| 11 (Inv.) | 0.72 | 0.79 | 0.78 | 125 | 126 | 130 | 4.01 | 3.98 | 3.98 | 4 |
| 12 (Inv.) | 0.73 | 0.75 | 0.77 | 97 | 91 | 94 | 2.33 | 2.41 | 2.43 | 4 |
| 13 (Inv.) | 0.72 | 0.76 | 0.79 | 99 | 92 | 93 | 2.44 | 2.41 | 2.49 | 4 |
| 14 (Inv.) | 0.73 | 0.76 | 0.75 | 99 | 96 | 98 | 2.39 | 2.43 | 2.47 | 4 |

As is apparent from Table 2, Samples 6 to 14 of which transmittances are within the scope of the invention comprise better balance between sharpness, sensitivity and Dmax, and higher practicabilities than Comparative Samples

Example 2

Samples were prepared and evaluated in the same manner as in Example 1, except that colloidal silver contained in the first and second backing layers of Sample 7 was replaced or used in combination with dyes AI-1, 2 and 3.

The result is shown in Table 3. The addition amounts of dyes are controlled so that the ratios of transmittances in each wavelength become the values shown in Table 3.

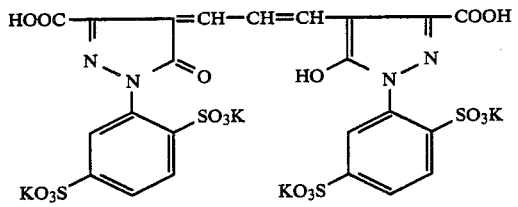

AI-1

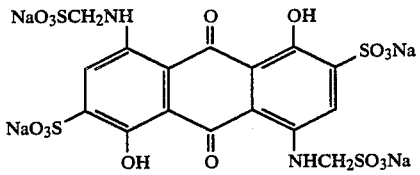

AI-2

-continued

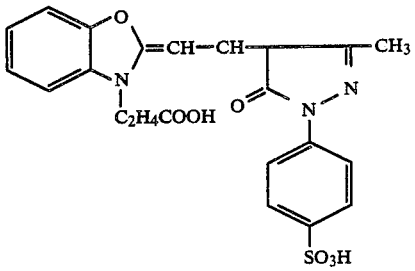

AI-3

TABLE 3

| Sample No. | AI dye | Colloidal silver (mg/dm²) | $\alpha_{700}$ | $\beta_{700}$ | $\alpha_{550}$ | $\beta_{550}$ | $\alpha_{450}$ | $\beta_{450}$ |
|---|---|---|---|---|---|---|---|---|
| 15 (Comp.) | AI-1 | — | 0.527 | 0.104 | 0.955 | 0.689 | 0.765 | 0.278 |
| 16 (Comp.) | AI-2 | — | 0.789 | 0.533 | 0.772 | 0.111 | 0.766 | 0.278 |
| 17 (Comp.) | AI-3 | — | 0.526 | 0.105 | 0.773 | 0.111 | 0.913 | 0.588 |
| 18 (Comp.) | AI-1 | 1.5 | 0.538 | 0.107 | 0.911 | 0.690 | 0.783 | 0.279 |
| 19 (Comp.) | AI-2 | 1.5 | 0.799 | 0.633 | 0.795 | 0.138 | 0.791 | 0.281 |
| 20 (Comp.) | AI-3 | 1.5 | 0.537 | 0.108 | 0.780 | 0.120 | 0.952 | 0.593 |
| 21 (Inv.) | AI-1 | — | 0.544 | 0.113 | 0.719 | 0.195 | 0.735 | 0.291 |
| 22 (Inv.) | AI-1 | 1.5 | 0.536 | 0.122 | 0.701 | 0.199 | 0.744 | 0.277 |
| 23 (Inv.) | AI-3 | — | 0.550 | 0.110 | 0.811 | 0.213 | 0.801 | 0.329 |
| 24 (Inv.) | AI-3 | 1.5 | 0.522 | 0.101 | 0.804 | 0.220 | 0.818 | 0.338 |
| 25 (Inv.) | AI-2 | — | 0.510 | 0.103 | 0.812 | 0.211 | 0.733 | 0.238 |
| 26 (Inv.) | AI-2 | 1.5 | 0.511 | 0.110 | 0.799 | 0.213 | 0.748 | 0.284 |

| | Sharpness | | | Sensitivity | | | Dmax | | | Practi- |
|---|---|---|---|---|---|---|---|---|---|---|
| Sample No. | Y | M | C | Y | M | C | Y | M | C | cability |
| 15 (Comp.) | 0.69 | 0.78 | 0.71 | 98 | 51 | 91 | 2.39 | 1.15 | 2.40 | 2 |
| 16 (Comp.) | 0.70 | 0.70 | 0.81 | 97 | 93 | 54 | 2.40 | 2.33 | 1.40 | 2 |
| 17 (Comp.) | 0.77 | 0.71 | 0.71 | 50 | 93 | 95 | 1.11 | 2.30 | 2.41 | 2 |
| 18 (Comp.) | 0.70 | 0.82 | 0.72 | 90 | 47 | 90 | 2.20 | 1.01 | 2.29 | 2 |
| 19 (Comp.) | 0.71 | 0.71 | 0.83 | 92 | 91 | 48 | 2.41 | 2.33 | 1.21 | 2 |
| 20 (Comp.) | 0.79 | 0.71 | 0.72 | 46 | 92 | 91 | 1.12 | 2.32 | 2.29 | 2 |
| 21 (Inv.) | 0.69 | 0.79 | 0.71 | 98 | 96 | 99 | 2.33 | 2.22 | 2.40 | 5 |
| 22 (Inv.) | 0.69 | 0.83 | 0.72 | 98 | 94 | 98 | 2.30 | 2.19 | 2.39 | 5 |
| 23 (Inv.) | 0.70 | 0.71 | 0.84 | 98 | 97 | 97 | 2.35 | 2.30 | 2.12 | 5 |
| 24 (Inv.) | 0.71 | 0.70 | 0.89 | 99 | 98 | 93 | 2.31 | 2.26 | 2.10 | 5 |
| 25 (Inv.) | 0.81 | 0.72 | 0.71 | 95 | 99 | 98 | 2.10 | 2.23 | 2.34 | 5 |
| 26 (Inv.) | 0.88 | 0.71 | 0.71 | 91 | 99 | 98 | 2.08 | 2.20 | 2.30 | 5 |

As is apparent from Table 3, the samples comprising AI dyes in place of colloidal silver exhibit the same results as in Example 1, as far as the transmittances in 450, 550 and 700 nm are within the scope of the invention.

Example 3

The samples were prepared and evaluated in the same manner as in Examples 1 and 2, except that in Samples 1 to 14 of Example 1 and Samples 15 to 26 of Example 2, Y-1 was replaced with Y-2 to Y-6; M-1 with M-2 to M-9; C-1 and C-2 with C-3 to C-9; AS-1 with AS-2 and AS-3; high boiling solvents DNP, DOP and DIDP with DBP, TOP, TCP, TINP, TEHP, DCPP, and THP; AI dyes AI-1 to AI-3 with AI-4 to AI-11; an image stabilizer ST-1 with ST-5, 6 and 9, and ST-3 with ST-7, 8, 10, 11 and 12; and a UV absorber UV-1 and 2 with UV-3 to 5.

The evaluation results were equivalent to those of Examples 1 and 2.
DBP : dibutylphthalate
TOP : trioctylphosphate
THP : trihexylphosphate
TCP : tricresylphosphate
TEHP: tri(2-ethylhexyl) phosphate
TINP: tri-isononylphosphate
DCPP: dicresyl phenylphosphate
Y-2
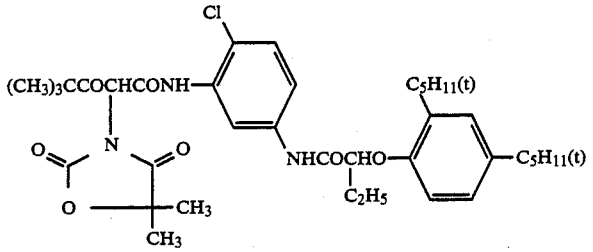
M-2
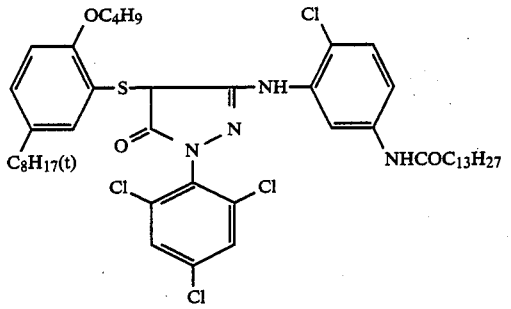
(an amount of silver coated to the third layer: 0.18 g/m$^{2)}$
C-3
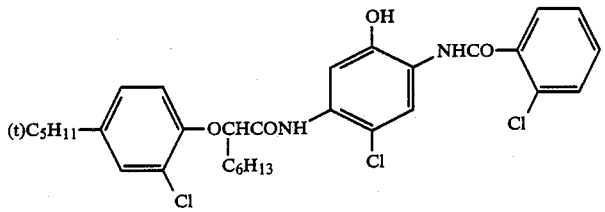
C-4
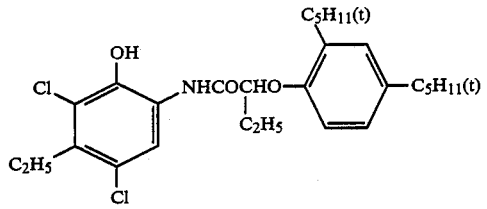
AI-4
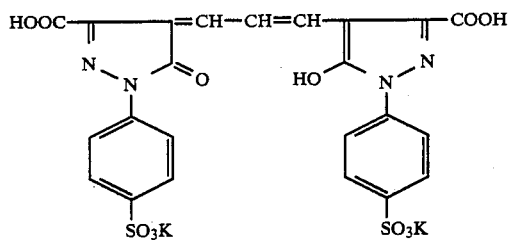
AI-5
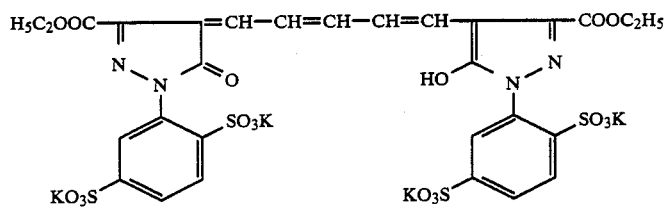

-continued
AS-2
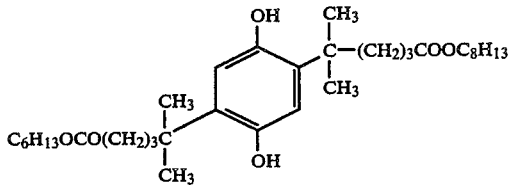
ST-5
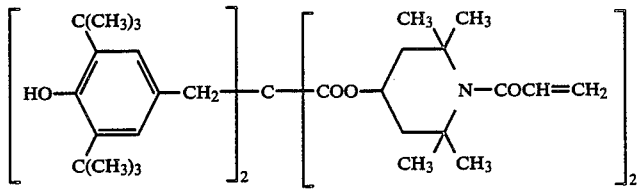
ST-6
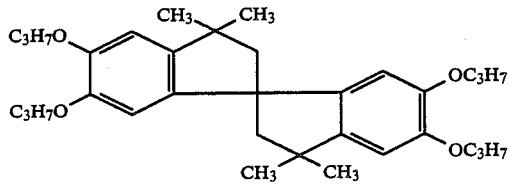
UV-3
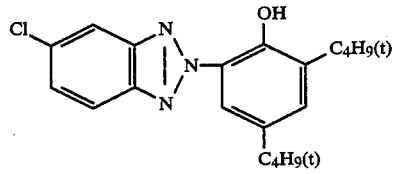
UV-4
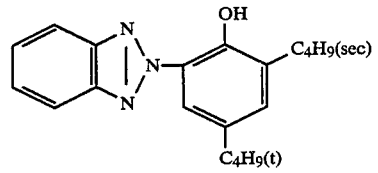
UV-5
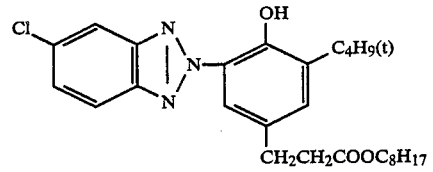
Y-3
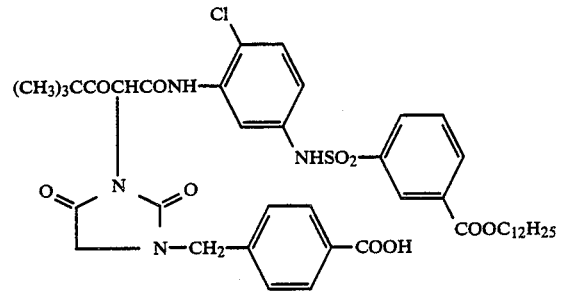

-continued
Y-4
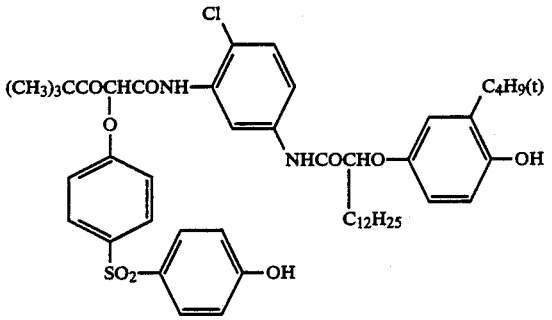
Y-5
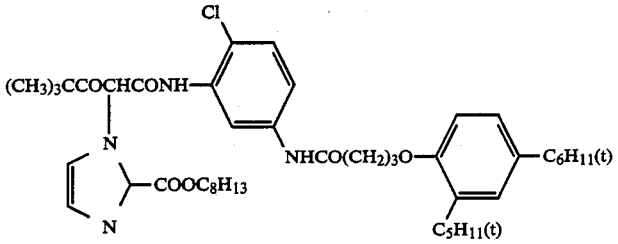
Y-6
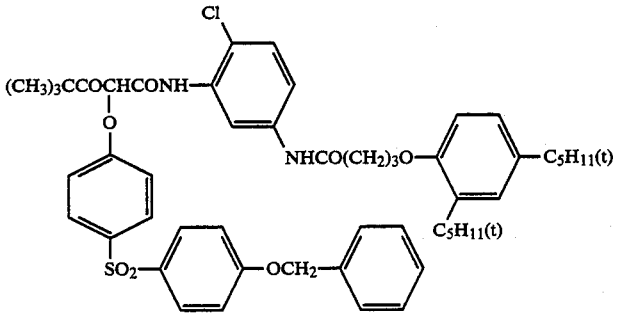
M-3
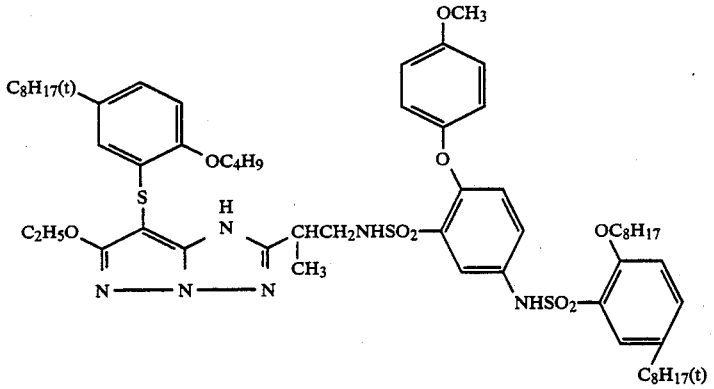
M-4
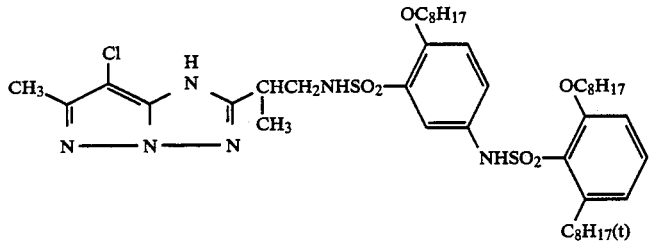

-continued
M-5
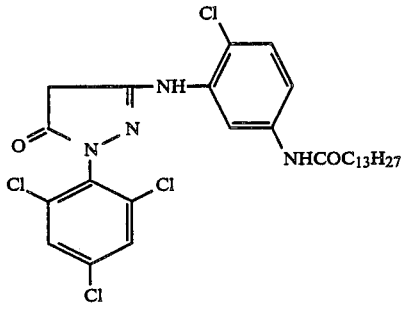
M-6
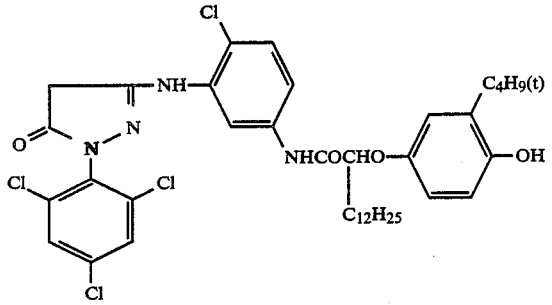
M-7
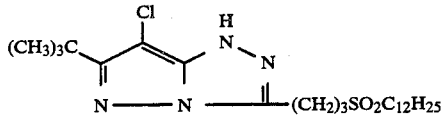
M-8
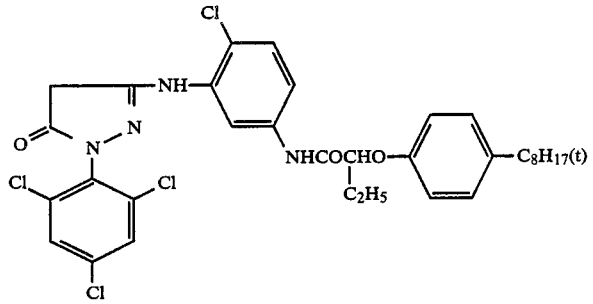
M-9
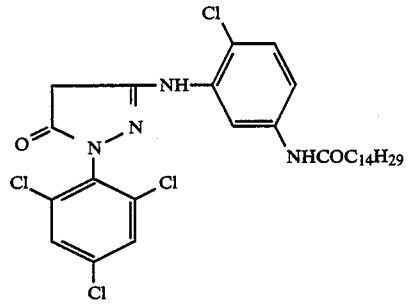
C-5
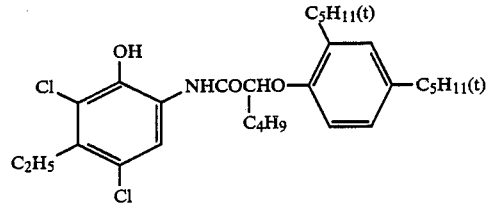

-continued
C-6
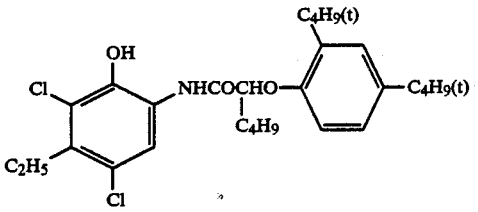
C-7
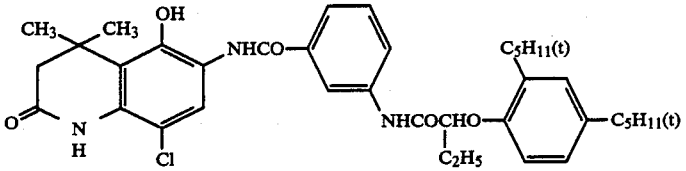
C-8
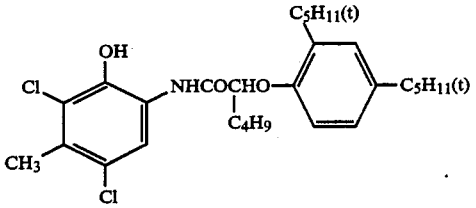
C-9
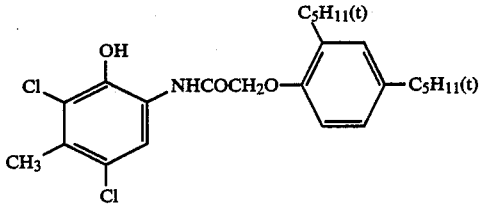
ST-7
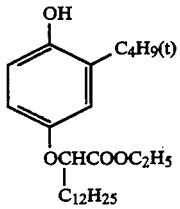
ST-8
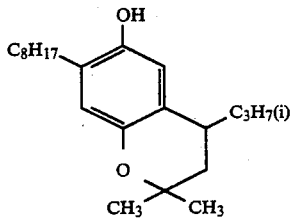
ST-9
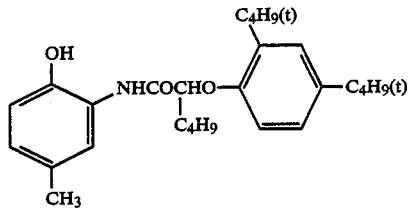
ST-10
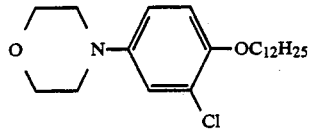

-continued
ST-11
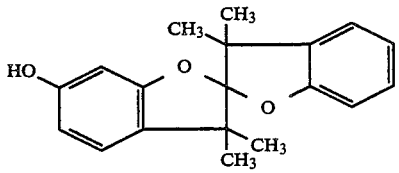
ST-12
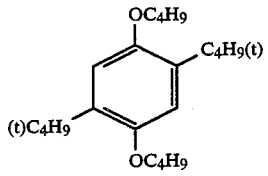
AS-3
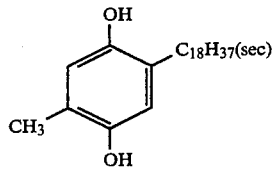
AI-6
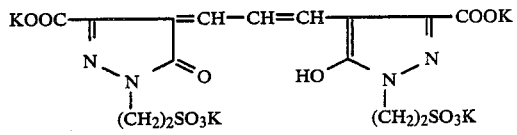
AI-7
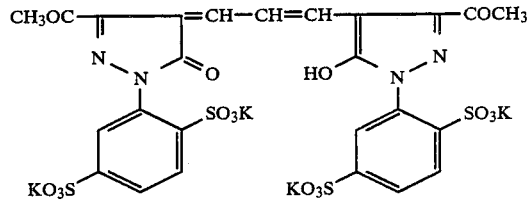
AI-8
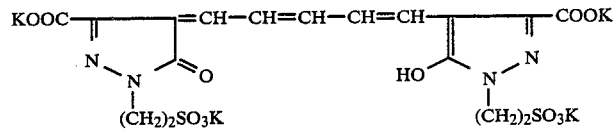
AI-9
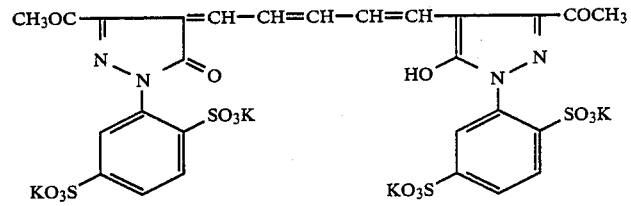
AI-10
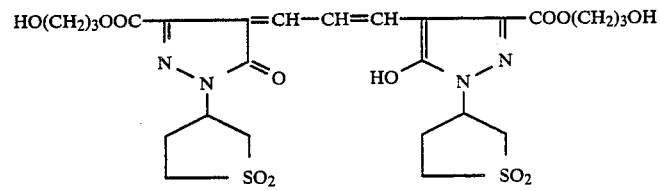

-continued

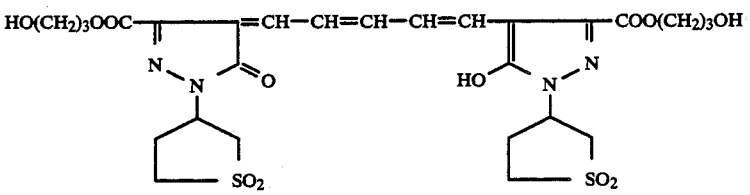

AI-11

Example 4

The samples were prepared and evaluated in the same manner as in Examples 1 and 2, except that in Samples 1 to 14 of Example 1 and Samples 15 to 26 of Example 2, the emulsions and the layer constitution were replaced with the following emulsions and that shown in Table 4, and Process A with Process B.

Preparation of blue sensitive silver halide emulsion

To 1,000 m of 2% gelatin solution kept at 40° C., the following solution A and solution B were added simultaneously in 30 minutes controlling pH and pAg at 3.0 and 6.5, respectively, and the solutions C and D were added simultaneously in 180 minutes at pH of 5.5 and pAg of 7.3, wherein pH was controlled with an aqueous sulfuric acid or an aqueous sodium hydroxide, and pAg was controlled with the method stated in Japan Patent O.P.I. Publication No. 45437/1984.

| | |
|---|---|
| Solution A | |
| NaCl | 3.42 g |
| KBr | 0.03 g |
| Total volume with water | 200 ml |
| Solution B | |
| $AgNO_3$ | 10 g |
| Total volume with water | 200 ml |
| Solution C | |
| NaCl | 102.7 g |
| KBr | 1.0 g |
| Total volume with water | 600 ml |
| Solution D | |
| $AgNO_3$ | 300 g |
| Total volume with water | 600 ml |

After finishing addition, the emulsion was subjected to desalination with a 5% solution of Demol N manufactured by Kao Atlas Co., Ltd. and a 20% solution of magnesium sulfate, and then was dispersed in a gelatin solution to obtain a monodispersed emulsion EMP-1 containing cubic silver halide grains having an average size of 0.85 μm, a variation coefficient ($\delta/\bar{r}$) of 0.07, and a silver chloride content of 99.5 mol %.

The above emulsion EMP-1 was subjected to chemical ripening at 50° C. in 90 minutes with the following compounds to obtain a blue-sensitive silver halide emulsion EM-A.

| | |
|---|---|
| Sodium thiosulfate | 0.8 mg/mol of AgX |
| Gold chloride | 0.5 mg/mol of AgX |
| Stabilizer SB-5 | $6 \times 10^{-4}$ mol/mol of AgX |
| Sensitizing dye D-1 | $5 \times 10^{-4}$ mol/mol of AgX |

Preparation of green sensitive silver halide emulsion

The above prescription for EMP-1 was repeated, except that adding time of solutions A and B and solutions C and D was changed, to obtain a monodispersed emulsion EMP-2. containing cubic silver halide grains having an average size of 0.43 μm, a variation coefficient ($\delta/\bar{r}$) of 0.08, and an AgC content of 99.5 mol %.

EMP-2 was subjected to chemical ripening at 55° C. in 120 minutes with the following compounds to obtain a green-sensitive silver halide emulsion EM-B.

| | |
|---|---|
| Sodium thiosulfate | 1.5 mg/mol of AgX |
| Gold chloride | 1.0 mg/mol of AgX |
| Stabilizer SB-5 | $6 \times 10^{-4}$ mol/mol of AgX |
| Sensitizing dye D-2 | $4 \times 10^{-4}$ mol/mol of AgX |

Preparation of red-sensitive silver halide emulsion

The prescription for EMP-2 was repeated to obtain a monodispersed emulsion EMP-3 containing cubic silver halide grains having an average size of 0.50 μm, a variation coefficient of 0.08, and an AgC content of 99.5 mol %.

EMP-3 was subjected to chemical ripening at 60° C. in 90 minutes with the following compounds to obtain a red-sensitive silver halide emulsion EM-C.

| | |
|---|---|
| Sodium thiosulfate | 1.8 mg/mol of AgX |
| Gold chloride | 2.0 mg/mol of AgX |
| Stabilizer SB-5 | $6 \times 10^{-4}$ mol/mol of AgX |
| Sensitizing dye D-3 | $8.0 \times 10^{-5}$ mol/mol of AgX |

SB-5

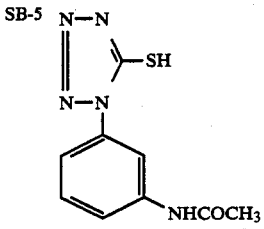

| Process B | | |
|---|---|---|
| | Temperature | Time |
| Color developing | 35.0 ± 0.3° C. | 45 sec. |
| Bleaching and fixing | 35 ± 0.5° C. | 45 sec. |
| Stabilization | 30–34° C. | 90 sec. |
| Drying | 60–80° C. | 60 sec. |

| Color developer | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxethylidene-1,1-diphosphonic acid | 1.0 g |
| Ethylenediamine tetracetic acid | 1.0 g |
| Disodium catecol-3,5-disulfonate | 1.0 g |
| N-ethyl-N-β-methanesulfonamide ethyl-3-methyl-4-aminoaniline sulfate | 4.5 g |

-continued

| Color developer | |
|---|---|
| Fluorescent brightening agent (4,4'-diaminostilbene disulfonic acid delivative) | 1.0 g |
| Potassium carbonate | 27 g |

Water was added to make total quantity 1 liter. pH was adjusted to 10.10.

| Bleach/fixer | |
|---|---|
| Ferric ammonium ethylenediamine tetracetate dihydrate | 60 g |
| Ethylenediamine tetracetic acid | 3 g |
| Ammonium thiosulfate (70% solution) | 100 ml |
| Ammonium sulfite (40% solution) | 27.5 ml |

Water was added to make total quantity 1 liter. pH was adjusted to 5.7 with potassium carbonate or glacial acetic acid.

| Stabilizer | |
|---|---|
| 5-chloro-2-methyl-4-isothiazoline-3-one | 1.0 g |
| Ethylene glycol | 1.0 g |
| 1-hydroxyethylidene-1,1-diphosphonic acid | 2.0 g |
| Ethylenediamine tetracetic acid | 1.0 g |
| Ammonium hydroxide (20% solution) | 3.0 g |
| Ammonium sulfite | 3.0 g |
| Fluorescent brightening agent (4,4'-diaminostilbene diphosphonic acid delivative) | 1.5 g |

Water was added to make total quantity 1 liter. pH was adjusted to 7.0 with sulfuric acid or potassium hydroxide.

TABLE 4

| Layer | Components | Addition amount |
|---|---|---|
| Seventh layer (protective layer) | Gelatin | 1.0 |
| Sixth layer (UV absorbing layer) | Gelatin | 0.6 |
| | UV absorber (UV-1) | 0.2 |
| | UV absorber (UV-2) | 0.2 |
| | Antistain agent (HQ-1) | 0.01 |
| | DNP | 0.2 |
| | PVP | 0.03 |
| | Anti-irradiation dye (AI-2) | 0.02 |
| Fifth layer (Red-sensitive layer) | Gelatin | 1.9 |
| | Red-sensitive silver halide emulsion (EM-C) | 0.4 |
| | Cyan coupler (C-1) | 0.35 |
| | Cyan coupler (C-2) | 0.5 |
| | Image stabilizer (ST-1) | 0.4 |
| | High boiling organic solvent (HB-1) | 0.2 |
| | Antistain agent (HQ-1) | 0.02 |
| | DOP | 0.6 |
| Fourth layer (UV absorbing layer) | Gelatin | 1.30 |
| | UV absorber (UV-1) | 0.40 |
| | UV absorber (UV-2) | 0.40 |
| | Antistain agent (HQ-1) | 0.03 |
| | DNP | 0.40 |
| Third layer (Green-sensitive layer) | Gelatin | 2.0 |
| | Green-sensitive silver halide emulsion (EM-B) | 0.5 |
| | Magenta coupler (M-1) | 0.7 |
| | Image stabilizer (ST-3) | 0.4 |
| | Image stabilizer (ST-4) | 0.2 |
| | Antistain agent (HQ-1) | 0.02 |
| | DOP | 0.6 |
| | Anti-irradiation dye (AI-1) | 0.03 |
| Second layer (Intermediate layer) | Gelatin | 1.20 |
| | Antistain agent (HQ-1) | 0.12 |
| | DIDP | 0.15 |

TABLE 4-continued

| Layer | Components | Addition amount |
|---|---|---|
| First layer (Blue-sensitive layer) | Gelatin | 2.6 |
| | Blue-sensitive silver halide emulsion (EM-A) | 0.6 |
| | Yellow coupler (Y-1) | 1.6 |
| | Image stabilizer (ST-1) | 0.6 |
| | Image stabilizer (ST-2) | 0.4 |
| | Antistain agent (HQ-1) | 0.04 |
| | DNP | 0.40 |
| Support | Polyethylene terephtalate containing $BaSO_4$ | |
| First backing layer | Gelatin | 2.0 |
| | UV absorber (UV-1) | 0.5 |
| | UV absorber (UV-2) | 0.2 |
| | Colloidal silver | * |
| Second backing layer (Protective layer) | Gelatin | 1.0 |
| | Colloidal silver | * |

In the table, an addition amount is indicated by $g/m^2$, and those of silver halide emulsion and colloidal silver are indicated by an amount converted to silver. The values of a sign * are regulated so that the values of $T_{A700}$, $T_{A550}$ and $T_{A450}$ become the same as those of Samples 1 to 14 of Example 1 and 15 to 26 of Example 2.

The evaluation results were equivalent to those of Examples 1 and 2.

HB-1

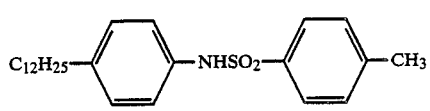

What is claimed is:

1. A silver halide photographic light-sensitive material having a support, a silver halide emulsion layer provided on one side of said support, and a backing layer provided on the other side of said support, wherein said support is of white color polyester, or comprises a layer containing a white pigment and provided on a side of the silver halide emulsion layer; and the transmittances of the support, the support plus the backing layer, and the silver halide photographic light-sensitive material in 450 nm, 550 nm and 700 nm satisfy the following equations;

$\alpha_{700}=T_{B700}/T_{A700}=0.30$ to 0.70

$\beta_{700}=T_{A700}/T_{0700}=0.05$ to 0.30

$\alpha_{550}=T_{B550}/T_{A550}=0.60$ to 0.90

$\beta_{550}=T_{A550}/T_{0550}=0.10$ to 0.50

$\alpha_{450}=T_{B450}/T_{A450}=0$ 60 to 0.90

$\beta_{450}=T_{A450}/T_{0550}=0.15$ to 0.50 wherein $T_{0700}$, $T_{0500}$ and $T_{0450}$ represent the transmittances of the support in 700 nm, 550 nm and 450 nm, respectively; $T_{A700}$, $T_{A550}$ and $T_{A450}$ represent the transmittances of the support plus the backing layer in 700 nm, 550 nm and 450 nm, respectively; and $T_{B700}$, $T_{B550}$ and $T_{B450}$ represent the transmittances of the silver halide photographic light-sensitive material in 700 nm, 550 nm and 450 nm, respectively.

2. The light-sensitive material of claim 1, wherein $T_{0700}$, $T_{0550}$ and $T_{0450}$ are 10 to 25%, 10 to 30% and 5 to 30%, respectively.

3. The light sensitive material of claim 2, wherein $T_{0700}$, $T_{0550}$ and $T_{0450}$ are 15 to 25%, 18 to 25% and 16 to 25%, respectively.

4. The light-sensitive material of claim 1, wherein:

$\alpha_{700}$=0.45 to 0.60
$\beta_{700}$=0.05 to 0.20
$\alpha_{550}$=0.70 to 0.85
$\beta_{550}$=0.15 to 0.30
$\alpha_{450}$=0.70 to 0.85
$\beta_{450}$=0.20 to 0.35.

5. The light-sensitive material of claim 4 wherein:
$\alpha_{700}$=0.50 to 0.55
$\beta_{700}$=0.08 to 0.15
$\alpha_{550}$=0.73 to 0.82
$\beta_{550}$=0.18 to 0.25
$\alpha_{450}$=0.72 to 0.82
$\beta_{450}$=0.23 to 0.33.

6. The light-sensitive material of claim 1, wherein said white pigment is sulfate or carbonate of an alkali earth metal, silicate, alumina, titanium oxide, zinc oxide, talk, or clay.

7. The light-sensitive material of claim 6, wherein said white pigment is barium sulfate or titanium oxide.

8. The light-sensitive material of claim 7, wherein an addition amount of said white pigment is 5 to 50 weight % of the support.

9. The light-sensitive material of claim 8, wherein an oxygen transmittance of the support is 2.0 ml/m$^2$·hr·atm.

10. The light-sensitive material of claim 9, wherein said oxygen transmittance is 1.0 ml/m$^2$·hr·atm.

11. The light-sensitive material of claim 9, wherein thickness of the support is 150 to 250 μm.

12. The light-sensitive material of claim 11, wherein said thickness is 160 to 200 μm.

13. The light-sensitive material of claim 1, wherein said silver halide photographic light-sensitive material comprises an antihalation layer containing an antihalation agent and provided on a reverse side of the silver halide emulsion layer.

14. The light-sensitive material of claim 13, wherein said antihalation agent is colloidal silver.

15. The light-sensitive material of claim 14, wherein an addition amount of said antihalation agent is 0.5 to 5.0 mg/ dm$^2$.

16. The light-sensitive material of claim 15, wherein an addition amount of said antihalation agent is 1.0 to 2.0 mg/ dm$^2$.

* * * * *